US005363629A

United States Patent [19]

Graffin

[11] Patent Number: 5,363,629

[45] Date of Patent: Nov. 15, 1994

[54] DEVICE FOR CLOSING RECEPTACLES BY WELDING ON LIDS, AND INSTALLATION INCLUDING THE SAME

[75] Inventor: André Graffin, La Ferte Bernard, France

[73] Assignee: Serac France, La Ferte Bernard, France

[21] Appl. No.: 21,906

[22] Filed: Feb. 24, 1993

[30] Foreign Application Priority Data

Mar. 3, 1992 [FR] France ..... 92 02522

[51] Int. Cl.[5] ..... B65B 7/28

[52] U.S. Cl. ..... 53/329.3; 53/298; 53/329.5; 53/426

[58] Field of Search ..... 53/329.5, 329.4, 329.3, 53/298, 297, 296, 288, 478, 426, 425

[56] References Cited

U.S. PATENT DOCUMENTS

| | | | |
|---|---|---|---|
| 3,693,318 | 9/1972 | Balzer et al. | 53/329.3 |
| 3,703,066 | 11/1972 | Marion et al. | 53/329.3 X |
| 3,720,038 | 3/1973 | Bryan, Jr. et al. | 53/329.3 X |
| 4,134,248 | 1/1979 | Freeman | 53/329.3 X |
| 4,226,072 | 10/1980 | Balzer et al. | 53/329.5 X |
| 4,282,698 | 8/1981 | Zimmermann | 53/329.3 X |

FOREIGN PATENT DOCUMENTS

| | | |
|---|---|---|
| 0110241 | 6/1984 | European Pat. Off. . |
| 2341485 | 2/1977 | France . |
| 2378714 | 2/1977 | France . |
| 899042 | 6/1962 | United Kingdom . |
| 2051668 | 7/1979 | United Kingdom . |

*Primary Examiner*—James F. Coan

*Attorney, Agent, or Firm*—Griffin, Butler, Whisenhunt & Kurtossy

[57] ABSTRACT

The closure device includes a roll of heat-fusible strip material, an end-of-strip support member, a receptacle placing member for placing successive receptacles at a receptacle closure location facing the end-of-strip support member, a weld head disposed above a placed receptacle, a grasping member disposed facing the end-of-strip support member, and a drive member disposed relative to the receptacle closure location on a side opposite to the end-of-strip support member.

8 Claims, 3 Drawing Sheets

DEVICE FOR CLOSING RECEPTACLES BY WELDING ON LIDS, AND INSTALLATION INCLUDING THE SAME

The present invention relates to a device for closing receptacles by welding on flat lids, and an installation including said device.

BACKGROUND OF THE INVENTION

Devices are known for fitting lids made of a complex of aluminum and of plastic, e.g. a complex of aluminum and polyethylene. In particular, devices are known for fitting capsules which are stamped in a capsule press and which are placed on bottlenecks by means of a chute and an applicator device.

Bottles that have received a capsule are conveyed to a heat-fusing device where the capsule is welded onto the bottleneck in autogeneous manner by means for heating the capsule and applying pressure thereto. That solution requires a capsule to have a skirt for the purpose of holding the capsule on the bottleneck while it is being transferred to the welding station, which implies that the capsule has sufficient thickness of metal to enable it to be shaped by stamping.

A device is also known, in particular from Document FR-A-2 290 389 for closing receptacles by welding flat lids obtained from a strip of heat-fusible material, said device including a roll of heat-fusible material in strip form, a member for supporting the end of the strip so that the end of the strip is cantilevered out therefrom, a member for placing receptacles so as to bring receptacles successively up to the support member, and a weld head disposed to move vertically above a receptacle that has been put in place. In that device, the strip is cantilevered out above the receptacle by means of a stepper advance member which pays out a determined length of strip over the receptacle, said length being sufficient to form a lid, the strip then being sectioned at the member for supporting the end of the strip to cut off a segment which is fixed to the neck of the receptacle by the weld head.

Such a method also assumes a sufficient thickness of metal on the strip to impart sufficient stiffness to the strip to enable the length required for making a lid to be capable of being cantilevered out before it is cut off. The closure strip is thus thicker than is strictly necessary for providing a sealed closure of the receptacle. In addition, the metal that provides adequate stiffness for the strip is not suitable for recycling, and as a result receptacles fitted with lids of this type are themselves not recyclable.

OBJECT AND SUMMARY OF THE INVENTION

An object of the invention is to provide a device for closing a receptacle by welding on flat lids, the device being suitable for use with very thin strips, complex strips of plastics comprising a layer of polyethylene teraphthalate associated with a layer of polyethylene, with the thickness of the strip being about 7/100 of a millimeter, and the strip not having sufficient thickness to enable it to be used in making stamped capsules or even for enabling it to be cantilevered out over a bottleneck.

For the purpose of achieving this object, the present invention provides a receptacle closure device for closing receptacles by welding on flat lids obtained from a strip of heat-fusible material, said device including a roll of heat-fusible strip material, an end-of-strip support member from which an end of the strip is cantilevered out, a receptacle positioning member for bringing receptacles respectively up to the end-of-strip support member, a weld head disposed to move vertically above a location for closing the receptacles, a grasping member disposed facing the end-of-strip support member, and a drive member disposed relative to the location for closing receptacles, on the side opposite to the end-of-strip support member, and connected to the grasping member to displace the grasping member between a first position in which the grasping member is disposed to grasp the cantilevered out end of the strip of heat-fusible material, and a second position in which the grasping member is spaced apart from the end-of-strip support member by a distance sufficient for the strip of heat-fusible material to be pulled under the weld head.

Thus, by cantilevering out a very short length of heat-fusible strip which is not in danger of sagging, e.g. a length lying in the range 5 mm to 25 mm, sufficient length of strip is made available for it to be grasped by the grasping means and pulled under the weld head so that it can then be welded onto the neck of a bottle. In addition, the length of strip grasped by the grasping member projects slightly beyond the neck of the bottle after welding, and may thus be used as a tab for tearing off the lid when the substance contained in the bottle is consumed.

BRIEF DESCRIPTION OF THE DRAWINGS

Other characteristics and advantages of the invention will appear on reading the following description of a particular, non-limiting embodiment of the invention described with reference to the accompanying drawings, in which.

MORE DETAILED DESCRIPTION

Figure 1:
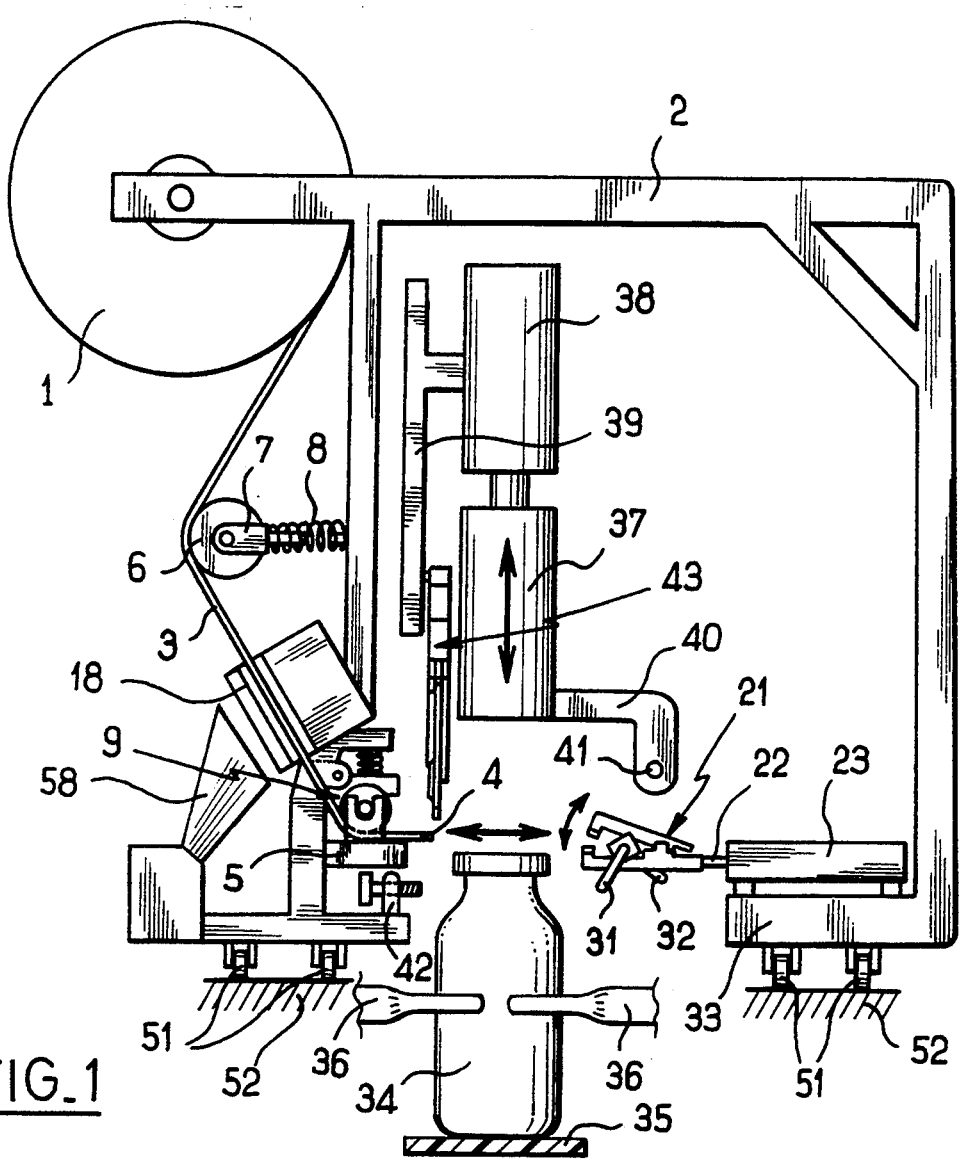
FIG. 1 is a diagrammatic elevation view of a device of the invention.

With reference to FIGS. 1 to 5, the receptacle closure device of the invention includes a roll of heat-fusible strip 1 carried by a bracket 2. A segment 3 of strip is paid out from the roll of strip 1 and includes an end 4 having a very short length cantilevered out from an end-of-strip support plate 5 which is also carried by the bracket 2. The segment 3 of strip is kept under tension by a strip-tensioner device comprising a wheel 6 carried by a fork 7 associated with the bracket 2 via a spring 8. The end 4 of the strip is retained by a strip-retaining member given overall reference 9, with one embodiment thereof being shown in FIG. 4.

In the embodiment shown, the strip-retaining member 9 includes a roller 10 carried by side plates 11 fixed to the end-of-strip support plate 5. The roller 10 has a shaft 12 engaged in slots 13 formed in the side plates 11 and it includes a middle groove 14 that receives thrust from a brake plate 15 disposed perpendicularly to the shaft 12 of the roller 10. The brake plate 15 is hinged to a fork 16 secured to the bracket 2 and it is pressed against the roller 10 by a spring 17 which is compressed between a segment of the bracket 2 and the top edge of the brake plate 15.

Figure 2:
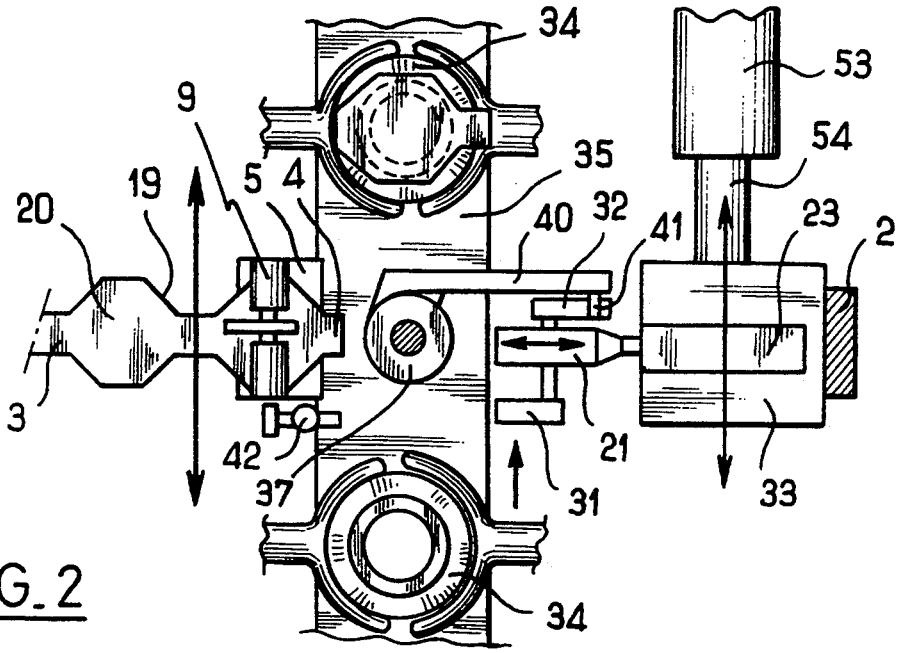
FIG. 2 is a plan view of the FIG. 1 device with certain members removed.

A strip cut-out member 18 is disposed between the strip-tensioner device and the strip-retaining member 9 to cut out segments of appropriate shape from the strip, the segments including side notches 19 delimiting lid blanks 20 in the strip (see FIG. 2). The cut-off portions of the strip are collected in a waste recovery box 58.

Opposite the end-of-strip support plate 5, the receptacle closure device includes a grasping member given overall reference 21 and fixed to the end of the rod 22 of an actuator 23.

Figure 3:
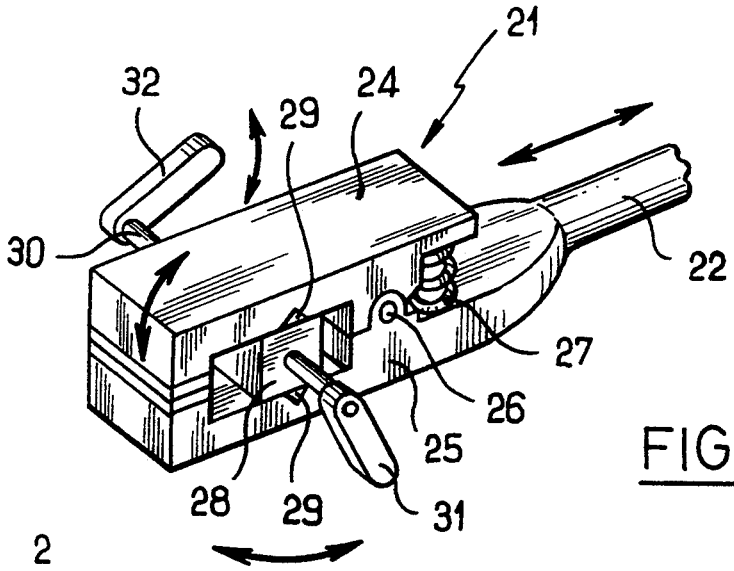
FIG. 3 is a perspective view of a member for grasping one end of the strip.
Figure 4:
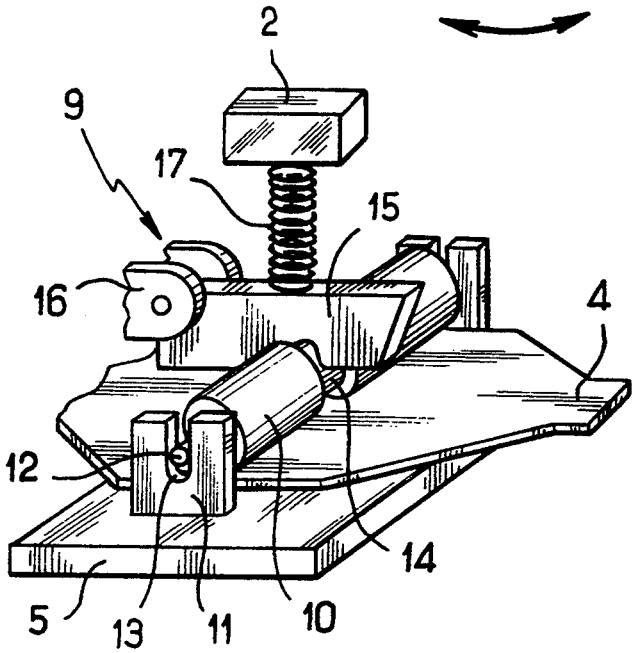
FIG. 4 is a perspective view of a strip-retaining member.

In the particular embodiment of the grasping member shown in FIG. 3, it is in the form of a clamp having jaws 24 and 25 that are hinged to each other about a pin 26 and that are urged towards a closed position by a spring 27. The bottom jaw 25 is fixed to the end of the actuator rod 22. A square section drive block 28 is disposed between the jaws of the grasping clamp 21. The jaws 24 and 25 include V-shaped grooves 29 adjacent to the drive block 28. The drive block 28 is fitted with a shaft 30 that is secured to the drive block 28 and which is associated with a close control lever 31 and an open control lever 32 that are disposed at 90° to each other. In the closed position shown in FIG. 3, the drive block 28 has two faces extending parallel to the inside faces of the jaws 24 and 25, with the close control lever 31 extending downwards and at rearwards 22.5° relative to a vertical plane including the shaft 30, and the open control lever 32 extends rearwards and at upwards 22.5° relative to a horizontal plane including the shaft 30. In the retracted position of the actuator 23 as shown in FIG. 1, the clamp 21 is held open by the drive block 28 being diagonally positioned between the jaws 24 and 25, with the edges of the drive block 28 being engaged in the V-shaped grooves 29 of the jaws. In this position, the close control lever 31 slopes forwards at 22.5° relative to the clamp, while the open control lever 32 slopes downwards at 22.5°. The actuator 23 is carried by a plate 33 secured to the bracket 2. Receptacles 34 are brought successively to a receptacle closure position facing the end-of-strip support member 5 by means of a receptacle positioning member including a carrier belt 35 associated with lateral guides 36. The actuator 23 is thus disposed on the side of the receptacle closure position opposite to the end-of-strip support member 5.

In this embodiment, the carrier belt 35 and the lateral guides 36 are advanced in steps. A weld head 37 is disposed in a fixed station so as to move vertically above a receptacle when placed in the receptacle closure position. The position of the weld head 37 is controlled by an actuator 38 carried by a frame element 39. An arm 40 is fixed to the weld head 37 and carries an open control lug 41 extending substantially vertically above the open control lever 32 of the clamp 21, with operation thereof being explained below. A close control abutment 42 for the grasping clamp 21 is secured to the base of the bracket 2 so as to be adjacent to the end-of-strip support plate 5.

Figure 5:
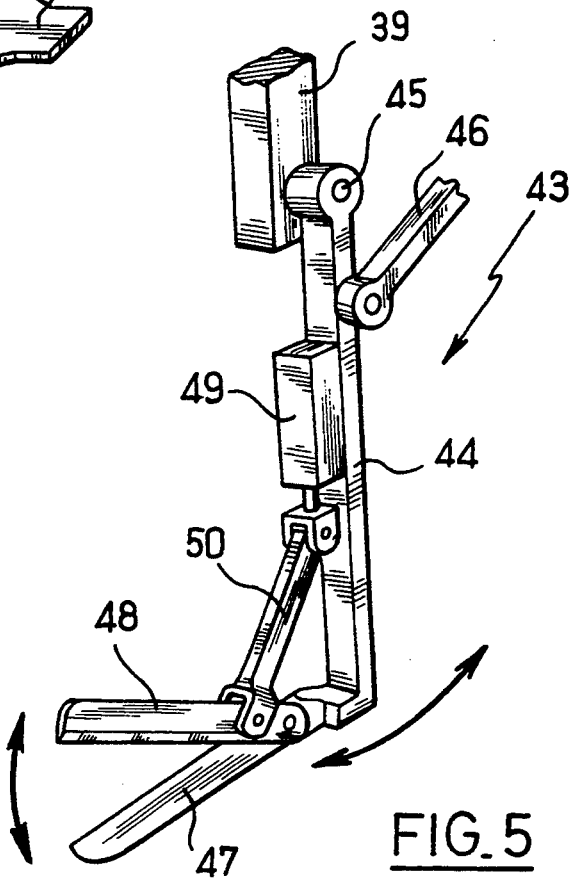
FIG. 5 is a perspective view of a strip-sectioning member.

A retractable strip-sectioning member given overall reference 43 is fixed to the frame element 39 and is shown in detail in FIG. 5. The retractable strip-sectioning member 43 includes a pivot arm 44 hinged about a pin 45 carried by the frame element 39. The position of the pivot arm 44 is determined by a connecting rod 46 connected to a drive member such as a cam, for example (not shown). At its bottom end, the pivot arm 44 carries a scissor blade 47 extending substantially perpendicularly to the pivot arm 44 and having a second scissor blade 48 hinged thereto, the second blade being connected to a drive member 49, e.g. an electromagnet, by a link 50. To clarify the drawing, the sectioning member 43 is not shown in FIG. 2.

The bracket 2 forms an intermediate frame which is movably mounted by means of wheels 51 running on fixed support plates 52. The position of the bracket 2 relative to the weld head 37 carried by the fixed frame element 39 is determined by a drive actuator 53 whose rod 54 is fixed to the plate 33 carrying the drive actuator 23 for the grasping clamp 21.

Although the bracket 2 is movable in the particular embodiment shown, the operation of the device of the invention is initially explained with reference to a device in which the bracket 2 is held stationary level with the weld head 37.

Figure 6:
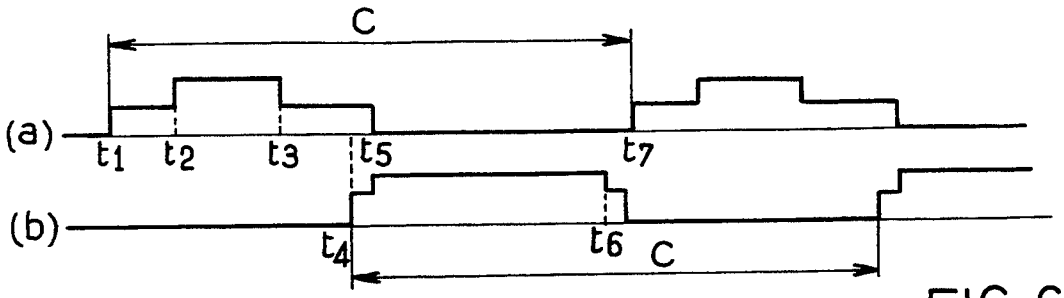
FIG. 6 is a cycle diagram for an installation that operates step by step.

The device is shown in the figures in positions where none of the receptacles is level with the end-of-strip support plate 5, which position may be obtained either by providing a corresponding pitch for the receptacle positioning member, or else it corresponds to an intermediate instant between two steps each having a receptacle at the end-of-strip support plate 5. This instant corresponds to instant t1 of line a of the operating diagram of FIG. 6. Line a of FIG. 6 shows the movements of the grasping clamp 21, while line b of FIG. 6 shows the movements of the weld head 37. At instant t1, the grasping clamp 21 is in its retracted position, the clamp being open as shown in FIG. 1. At this instant t1, the actuator 23 is actuated to advance the grasping clamp 21 towards the end 4 of the strip of heat-fusible material. At instant t2, the grasping clamp 21 reaches a first position in which it is placed ready to grasp the cantilevered-out end 4 of the strip of heat-fusible material. At this instant t2, the close control lever 31 of the grasping clamp 21 comes into contact with the close control abutment 42, thereby causing the lever 31 to pivot to its rearwardly sloping position and simultaneously causing the lever 32 to pivot upwards, as shown in FIG. 3. The grasping clamp 21 therefore closes on the end 4 of the strip. It may be observed that at this instant, the sectioning member 43 is retracted, i.e. the pivot arm 44 is raised so that the scissor blades 47 and 48 are not facing the end 4 of the strip. At this instant t2, the actuator 23 is actuated in the retraction direction, with the stroke of the actuator 23 being such that at instant t3 which corresponds to the actuator 23 being in its retracted position, the grasping clamp 21 is in a second position where it is separated from the end-of-strip support member 5 by a distance sufficient to ensure that the strip of heat-fusible material has been pulled under the weld head 37. A receptacle 34 is then brought under the weld head 37, either by advancing the receptacle positioning member by one step or else because the time taken for a receptacle to move one step has expired.

At instant t4, the actuator 38 is actuated to lower the weld head 37. It may be observed that at the beginning of this movement, the open control lever 32 of the grasping clamp 21 extends rearwards and slightly upwards as shown in FIG. 3, and therefore lies beneath the open control lug 41 carried by the arm 40 associated with the weld head 37. When the weld head 37 comes level with the neck of the receptacle, it presses thereagainst the lid blank 20 which has been pulled by the grasping clamp 21, and simultaneously the open control lug 41 acts on the open control lever 32 in order to cause the drive block 28 to tilt back into a diagonal position as shown in FIG. 1. The grasping clamp 21 therefore opens to release the end of the heat-fusible strip.

During the down stroke of the weld head, or during the welding stage proper which is represented on line b of FIG. 6 between instants t5 and t6, the sectioning member 43 is moved to face the end-of-strip support member 5 and is actuated to cut off the lid installed on the neck of the receptacle, and to release the segment 3 of strip. At instant t6, the actuator 38 is again actuated to raise the weld head 37, the closed receptacle is advanced, and a new cycle begins at instant t7 where the device is again in a position analogous to that of instant t1.

Figure 7:
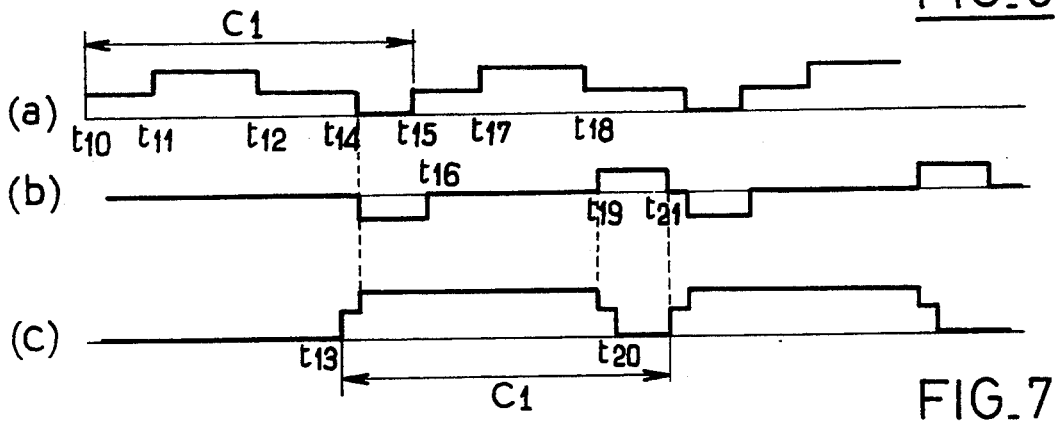
FIG. 7 is a cycle diagram for the device of the invention in another embodiment of an installation that operates step by step.

FIG. 7 shows the operation of the closure device of the invention when mounted in an installation where the bracket 2 is movable. As before, line a in FIG. 7 represents the movements of the grasping clamp 21, but this time line b represents the movements of the bracket 2, and line c represents the movements of the weld head 37. When the installation starts, as represented by instant t10, there is no receptacle under the weld head 37 and the grasping clamp is advanced in the open position. At instant t11, the grasping clamp is closed on the end 4 of the strip as described above, and the actuator 23 is retracted. At instant t12, the actuator 23 is fully retracted and a receptacle 34 has been advanced beneath the segment of strip pulled by the grasping clamp 21. At instant t13, the weld head 37 is lowered as before and the sectioning member is simultaneously put into place so that at the instant when the open control lug 41 reaches the open control lever 32 and causes the clamp 21 to open, the lid is simultaneously cut off. At said instant t14, the weld head 37 welds the lid on the receptacle that is in position beneath the weld head 37, and the drive actuator 53 is simultaneously extended to push back the bracket 2 together with the members it carries into an intermediate position between the receptacle that is being closed and the following receptacle, such that at instant t15 that follows the beginning of the backwards movement of the bracket 2, a new cycle can begin for the movements of the clamp 21, with instants t16, t17, and t18 corresponding respectively to instants t10, t11, and t12. Instant t16 corresponds to the end of the backwards movement of the bracket 2.

At instant t19, a little before the end of this cycle of the clamp 21, the actuator 53 is retracted to return the bracket 2 to level with the weld head 37, with instant t19 when the forwards movement of the bracket 2 begins coinciding with the end of the current lid welding operation so that the weld head 37 is raised at the movement when the bracket 2 comes back over the weld head 37 with a new lid already pulled out by the grasping clamp 21. By comparing FIGS. 6 and 7, it can thus be seen that having a moving bracket 2 makes it possible for a new lid blank 20 to be pulled out in "masked" time such that the cycle time required for closing a receptacle is reduced from time C shown in FIG. 6 to greatly reduced time C1 shown in FIG. 7. A much higher receptacle closing throughput is thus obtained.

Figure 8:
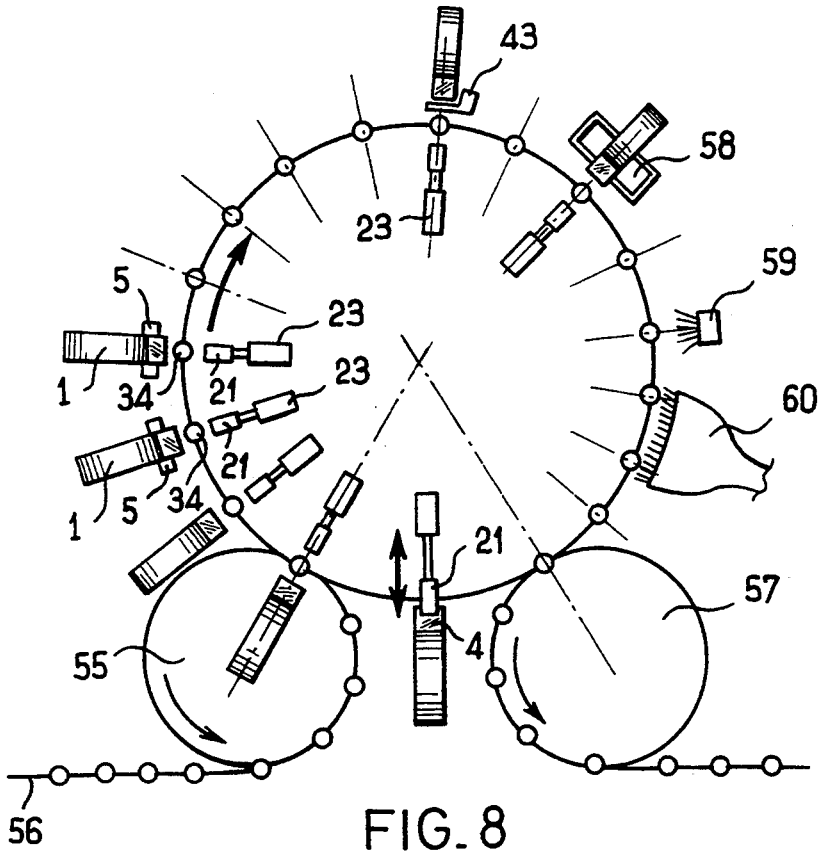
FIG. 8 is a diagrammatic plan view of a carousel fitted with devices of the invention.

FIG. 8 shows how the device of the invention can be installed on a receptacle closing carousel that operates continuously. Each carousel station is fitted with a closure device of the invention, at least in its minimum version, i.e. including the roll of strip 1, the end-of-strip support member 5, the grasping member 21 together with its drive member, and the weld head 37 together with its drive member (to clarify the drawing, the number of devices shown has been reduced to a few only). The receptacles to be closed are installed on the carousel by a receptacle installing member 55, which takes receptacles from a receptacle storage line 56 that comes from a receptacle filling installation. The cycle during which lids are actually welded takes place while a receptacle is being moved from the receptacle installing member 55 and a receptacle extracting member 57 adjacent to the receptacle installing member 55 but at the opposite end of the arc of a circle around which the receptacles travel while they are being closed.

In this respect, it may be observed that wherever the receptacles are travelling round the platform, the grasping head 21 cannot be advanced towards the end 4 of the strip because of the obstacle constituted by the neck of the receptacle. The end 4 of the strip is thus grasped while the platform is travelling through the angle that lies between the receptacle extracting member 57 and the receptacle installing member 55, as shown in FIG. 8 where the station shown in said portion of the circuit is shown with the grasping clamp 21 in its extended position and this is emphasized by the double-headed arrow which represents the go-and-return movement of the clamp 21.

It may also be observed that each station is not necessarily fitted with members that are used for very short periods only within the cycle. In particular, FIG. 8 shows a carousel in which the sectioning member 43 is mounted in a fixed station and cuts off a segment 3 of the passing strip so as to release the lid while said segment of strip is being welded. Similarly, the strip can be cut out to form the lid blanks 21 at a moment when one of the stations of the carousel is moving past a box for recovering waste 58, likewise installed as a fixed station.

In this embodiment, there can also be seen a member 59 for spraying a sterilizing substance and a hot air drying station 60 which are disposed in stationary manner to sterilize that portion 3 of the passing strip that has just been cut by the cut-out member 18 carried by the carousel and associated with the station moving past the sterilizing members.

Naturally the invention is not limited to the embodiments described and variants can be applied thereto without going beyond the scope of the invention. In particular, in an installation where receptacles advance step by step, the sectioning member 43 may be associated in fixed manner with the end-of-strip support member 5. However, under such circumstances it is still necessary to provide a strip advance member in order to cause the end 4 of the strip that has just been cut off to advance so that it is cantilevered out from the end-of-strip support member in order to enable the grasping clamp 21 to grasp the end 4 of the strip without interfering with the sectioning member.

When the bracket 2 is a moving bracket, it may be retracted relative to the weld head either in the receptacle displacement direction (as shown), or else in any other way that serves to release the access path used by the clamp to reach the cantilevered out end of the strip, e.g. by pivoting about a vertical axis, so as to provide an angular offset between the clamp and the segment 3 of the strip.

The welding operation performed in the invention should be understood as being an autogenous welding operation with the strip having a layer of the same composition as the receptacle, or else as being a heterogeneous welding operation with a hot melt glue being disposed as a thin layer on the underside of the strip.

I claim:

1. A receptacle closure rotatable carousel, comprising a series of stations at which receptacles are receivable for closing in a continuous manner, each station having a receptacle closure means for closing receptacles by welding flat lids on the receptacle, said flat lids being obtainable from a heat-fusible strip material, said closure means comprising a means for supplying the heat-fusible strip material, an end-of-strip support member from which an end of the strip is cantileverable, a receptacle positioning member for bringing respective receptacles up to the end-of-strip support member, a weld head disposed to move vertically above a location for closing the receptacles, a grasping member disposed facing the end-of-strip support member, and a drive member disposed relative to the location for closing the receptacles on the side opposite to the end-of-strip support member and connected to the grasping member such as to displace the grasping member radially with respect to the carousel between a first position in which the grasping member is positioned to grasp the cantileverable end of the strip, and a second position in which the grasping member is spaced apart from the end-of-strip support member by a distance sufficient for the strip to be pulled under the weld head.

2. A receptacle closure device according to claim 1, including a strip-sectioning member disposed as a fixed station.

3. A receptacle closure device according to claim 1, including a grasping member close control abutment adjacent to the end-of-strip support member, and a grasping member open control member associated with the weld head.

4. A receptacle closure device according to claim 1, including sterilization members disposed as a fixed station immediately upstream in a carousel rotation direction from a member for extracting receptacles.

5. A receptacle closure device according to claim 1, including a strip cut-out member for cutting a lid blank from the strip between the means for supplying the strip and the end-of-strip support member.

6. A receptacle closure machine, comprising a closure means for closing receptacles by welding flat lids on the receptacles, said flat lids being obtainable from a strip of heat-fusible material, said closure means comprising a step-by-step receptacle transport member, a weld head carried by a frame element and disposed to move vertically above a location at which the receptacles are receivable from said receptacle transport member, a bracket associated with a drive member for moving said bracket relative to the weld head, said bracket having means for supplying the strip, an end-of-strip support member from which an end of the strip is cantileverable, a grasping member disposed facing the end-of-strip support member and connected to a drive member disposed for displacing the grasping member between a first position at which the grasping member is positioned to grasp the cantileverable end of the strip, and a second position in which the grasping member is spaced apart from the end-of-strip support member such that the strip is pullable by a distance corresponding to a dimension of a lid.

7. A receptacle closure machine according to claim 6, including a grasping member close control abutment adjacent to the end-of-strip support member, and a grasping member open control member associated with the weld head.

8. A receptacle closure machine according to claim 6, including a strip cut-out member for cutting a lid blank from the strip between the means for supplying the strip and the end-of-strip support member.

* * * * *